United States Patent [19]

Arroyo

[11] Patent Number: 4,850,728

[45] Date of Patent: Jul. 25, 1989

[54] CONCRETE TRUCK DELIVERY CHUTE CLEANING TOOL

[76] Inventor: Daniel R. Arroyo, 322 W. Anapamu, Apt. #7, Santa Barbara, Calif. 93190-2144

[21] Appl. No.: 243,678

[22] Filed: Sep. 13, 1988

[51] Int. Cl.[4] ..... B01F 15/00; B08B 13/00

[52] U.S. Cl. ..... 401/139; 15/105; 15/236.07; 401/9; 401/261

[58] Field of Search ..... 15/105, 118, 121, 104.16, 15/104.31, 236.05, 236.07; 401/9, 139, 266

[56] References Cited

U.S. PATENT DOCUMENTS

| | | | |
|---|---|---|---|
| 4,380,840 | 4/1983 | Rieckenberg | 15/105 |
| 4,467,490 | 8/1984 | Adams | 15/105 |
| 4,549,611 | 10/1985 | Mills | 16/105 X |

*Primary Examiner*—Edward L. Roberts

[57] ABSTRACT

A tool for cleaning concrete truck delivery chutes. The tool comprises an elongated handle portion having a generally disc-shaped head portion carried at one end thereof. The head portion comprises a substantially semicircular rigid plate portion extending substantially perpendicular to the handle portion and configured to conform to the inner contour of a concrete truck delivery chute. A substantially semicircular flexible portion extends perpendicularly from the handle portion substantially opposite to the rigid portion and projects forwardly at an angle of approximately 45° from the plane of the rigid portion. The flexible portion is configured to conform to the inner contour of a concrete truck delivery chute and tapers radially outward to form a squeegee edge to facilitate removal of water from the chute.

8 Claims, 3 Drawing Sheets

CONCRETE TRUCK DELIVERY CHUTE CLEANING TOOL

BACKGROUND

1. FIELD OF INVENTION

This invention relates to chute cleaning tools and is particularly directed to tools for scraping and cleaning the chutes of concrete trucks and the like.

2. Prior Art

The transportation and delivery of concrete and the like in mixer trucks is a major part of today's construction industry. Many such trucks can be seen each day traveling to or from construction sites or delivering concrete to wheelbarrows or molding forms at the construction sites. As is well known, these trucks carry the concrete in large rotating mixing drums, which are part of the trucks, and deliver the concrete by means of delivery chutes which are pivotally mounted on the trucks and which, when needed, can be swung into position to guide the concrete discharged from the mixing drum to the desired delivery point.

Once the concrete has been delivered, a major part of the driver's job is to wash the truck, including the delivery chute. It is extremely important that this washing be done promptly and thoroughly after each delivery, as soon as the delivery is completed, because any concrete which is not removed quickly will harden and become impossible to remove. If even trace amounts of concrete are allowed to remain and harden, they interfere with the flow of future deliveries and tend to gather additional amounts of concrete until the accumulation requires replacement of the delivery chute. Obviously, such replacement is very expensive and careless cleaning of the truck and delivery chute is a common cause for driver dismissal.

Despite the importance of frequent and thorough cleaning of the delivery chutes, no tools have been proposed heretofore specifically for accomplishing such cleaning. In practice, drivers have used water hoses to flush the residual concrete off of the delivery chute and truck. Concrete trucks always carry water tanks to provide water for mixing with the concrete to maintain the concrete is a semi-fluid condition during transportation. Whatever water is left in the tank, after delivery of the concrete, can be used for cleaning. Unfortunately, large quantities of water can easily be consumed in such cleaning and substantial additional water is wasted in the process. Furthermore, water is quite heavy and carrying excess water on the truck significiantly increases fuel costs and, hence, erodes the profitabilitiy of the operation. Thus, the quantity of water carried in the truck tanks is closely monitored and is frequently insufficient for adequate cleaning of the chute and truck. Additional water may be available from other sources at or near the construction site. However, water is very often in short supply and, even where such additional water is available, some more rigid means may be needed to remove stubborn or partially hardened quantities of concrete. Heretofore, drivers have employed shovels or brooms for this purpose. However, brooms are too flexible to remove semi-hardened quantities of concrete and shovels are not configured to fit the contour of most concrete truck delivery chutes. Thus, these devices have been only partially successful and no tool has been previously proposed specifically for this purpose. Another problem which the concrete truck drivers face is the fact that excess water remaining on the delivery chute, after the cleaning operation, must be carefully removed to prevent rusting of the delivery chute which, again, can necessitate costly replacement of the chute.

A search in the United States Patent Office has revealed the following patents:

| Patent No. | Inventor | Issue Date |
|---|---|---|
| 3,858,267 | A. Swannie | Jan. 7, 1975 |
| 4,380,840 | I.L. Rieckenberg | Apr. 26, 1983 |
| 4,422,206 | A.W. Brace et al | Dec. 27, 1983 |
| 4,542,553 | A.P. Cary | Sep. 24, 1985 |

The patents to Swannie and Cary disclose scrapers for roof gutters. However, these references do not contemplate the problems inherent in cleaning concrete truck delivery chutes and, consequently, are only of general interest. The remaining patents located in the search are less pertinent. Thus, there appears to be no satisfactory prior attempt to provide a tool for cleaning concrete truck delivery chutes.

BRIEF SUMMARY AND OBJECTS OF INVENTION

These disadvantages of the prior art are overcome with the present invention and a concrete truck delivery chute cleaning tool is proposed which permits maximum efficiency in using the available water for such cleaning and which also serves both to facilitate removal of stubborn or partially hardened material from the chute and to ensure thorough removal of excess water after the cleaning operation is completed.

The advantages of the present invention are preferably attained by providing a concrete truck delivery chute cleaning tool comprising an elongated handle portion having a generally disc-shaped head portion carried at one end thereof; said head portion comprising a substantially semiconductor rigid plate portion extending substantially perpendicular to said handle portion and configured to conform to the inner contour of a concrete truck delivery chute; and a substantially semicircular flexible portion extending perpendicularly from said handle portion substantially opposite to said rigid portion and projecting forwardly at an angle of approximately 45° from the plane of said rigid portion, said flexible portion being configured to conform to the inner contour of a concrete truck delivery chute and tapering radially outward to form a squeegee edge to facilitate removal of water from said chute. Means may be provided for delivering water to suitable sprayhead means positioned adjacent the head portion of the tool to deliver water to the work area of the tool to facilitate the most efficient usage of the water and to minimize wasting of the water.

Accordingly, it is an object of the present invention to provide improved tools for cleaning concrete truck delivery chutes.

Another object of the present invention is to provide improved tools for cleaning concrete truck delivery chutes which facilitates removal of stubborn and partially hardened material from said chutes.

A further object of the present invention is to provide improved tools for cleaning concrete truck delivery chutes which facilitates thorough removal of excess water from said chutes after the cleaning operation to prevent rusting of said chutes.

An additional object of the present invention is to provide improved tools for cleaning concrete truck delivery chutes which facilitates maximum efficiency in the use of water supplied to said chutes during the cleaning operation and minimizes unnecessary water usage.

A specific object of the present invention is to provide improved tools for cleaning concrete truck delivery chutes, said tools comprising an elongated handle portion having a generally disc-shaped head portion carried at one end thereof; said head portion comprising a substantially semicircular rigid plate portion extending substantially perpendicular to said handle portion and configured to conform to the inner contour of a concrete truck delivery chute; and a substantially semicircular flexible portion extending perpendicularly from said handle portion substantially opposite to said rigid portion and projecting forwardly at an angle of approximately 45° C. from the plane of said rigid portion, said flexible portion being configured to conform to the inner contour of a concrete truck delivery chute and tapering radially outward to form a squeegee edge to facilitate removal of water from said chute.

These and other objects and features of the present invention will be apparent from the following detailed description, taken with reference to the figures of the accompanying drawing.

DETAILED DESCRIPTION OF THE INVENTION

Figure 1:
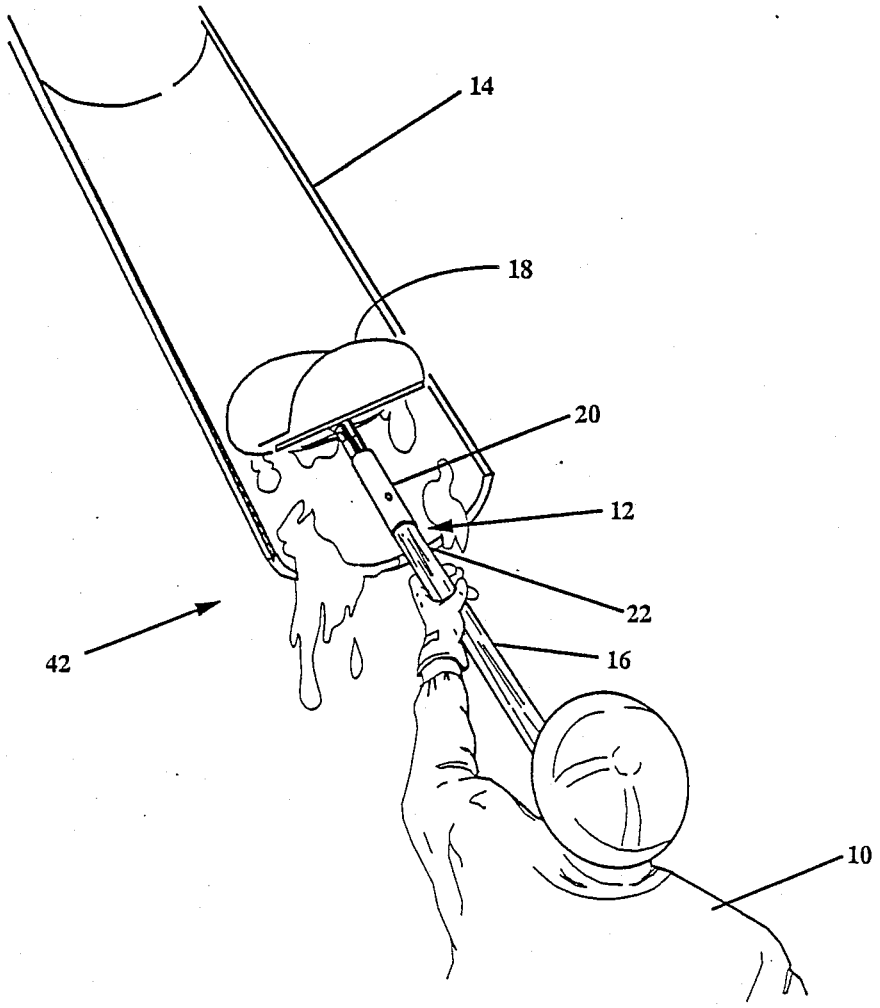
FIG. 1 is a diagrammatic representation showing a concrete truck driver cleaning the delivery chute of a concrete truck using a chute cleaning tool embodying the present invention.
Figure 2:
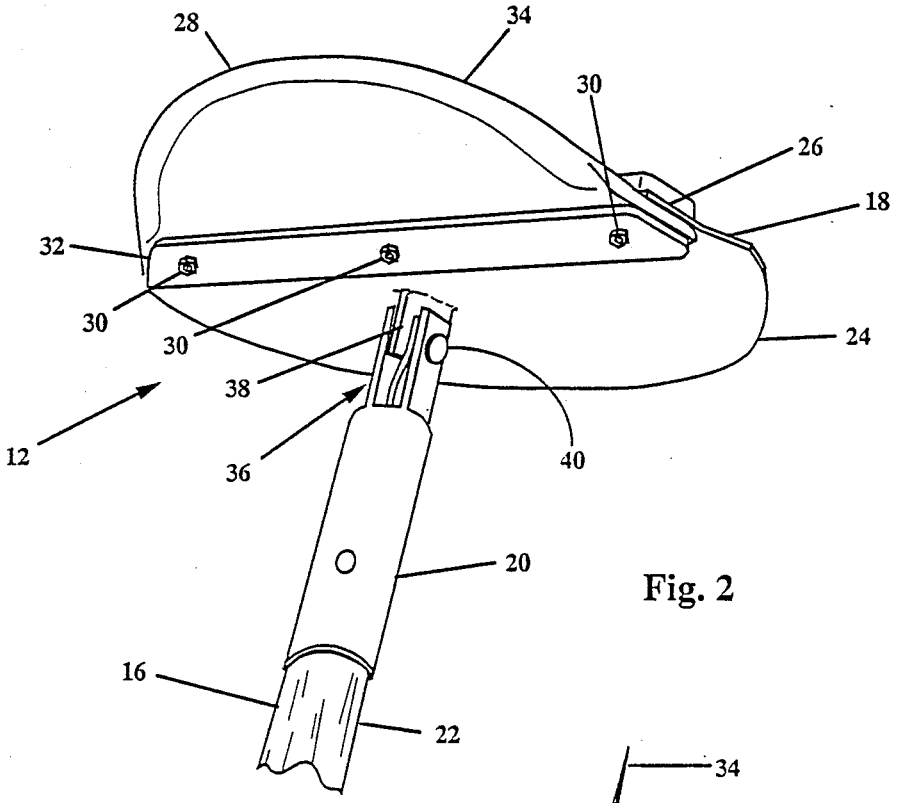
FIG. 2 is an enlarged view showing the head of the chute cleaning tool of FIG. 1.
Figure 3:
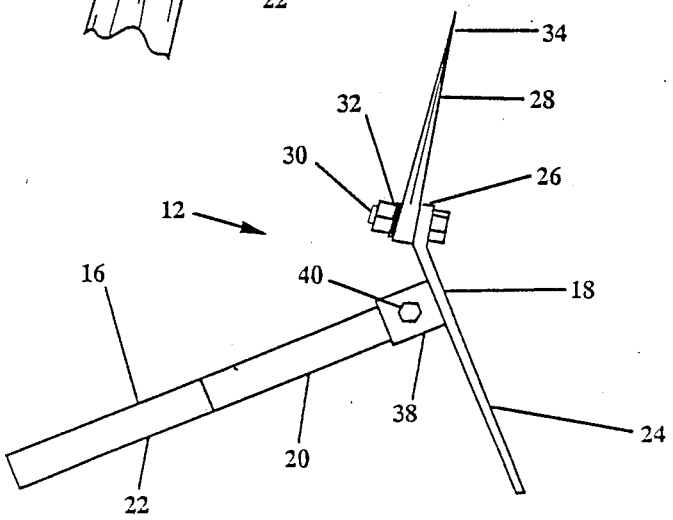
FIG. 3 is a side view of the head of the chute cleaning tool of FIG. 1.

In this form of the present invention chosen for purposes of illustration in FIGS. 1, a concrete truck driver 10 is shown using a chute cleaning tool, indicated generally at 12, to clean the delivery chute 14 of a concrete truck, not shown. As best seen in FIGS. 1–3, the chute cleaning tool 12 comprises an elongated handle 16 and a generally disc-shaped head portion 18 having a sleeve 20 projecting substantially perpendicularly from the backside of the head portion 18 to slideably receive one end 22 of the handle 16 to facilitate securing the head 18 to the handle 16. The head 18 comprises a rigid plate portion 24 which is substantially semcircular, but is configured to conform to the inner contour of a concrete truck delivery chute and, hance, may be somewhat oval. The plate portion 24 is preferably formed of metal and the sleeve 20 projects rearwardly from the back of the plate portion 24. The upper edge of the plate portion 24 extends above the sleeve 20 to form a flange 26 and is bent forwardly at an angle of approximately 45° and a generally semicircular flexible portion 28 is secured to the flange 26, as by bolts 30 and backing strip 32, and tapers radially outward to provide a sequeegee edge 34. As best seen in FIG. 2, the sleeve 20 may be bifurcated, as seen at 36 and may be secured to a flanger 38 on the rear of the plate portion 24 by suitable means, such as bolts 40. Alternatively, if desired, the sleeve 20 could be welded to, or formed integral with, the back of the plate portion 24. The handle 16 should be sufficiently long to enable the concrete truck driver 10 to reach the uppermost parts of the chute 14 with the chute cleaning tool 12 without undue effort. Also, the handle 16 should be of a diameter which will comfortably fit the driver's hands, yet will provide sufficient strength and rigidity to permit vigorous scraping of the chtue 14 which the chute cleaning tool 12. Also, the handle 16 may be formed of wood, as indicated in FIGS. 1–3, or may be formed of metal or plastic tubing of adequate strength.

In use, when the concrete truck driver 10 has completed delivering a load of concrete, he uses the chute cleaning tool 12 to scrape any residual concrete out of the concrete truck delivery chute 14, as shown in FIG. 1, using the rigid plate portion 24 to scrape the residual concrete out of the chute, as indicated at 42 in FIG. 1. Obviously, the plate portion 24 must be sufficiently strong to permit the driver 10 to vigorously scrape any partially hardened concrete off of the chute 14. Water may be hosed onto the chute to flush some residual concrete out of the chute 14 and to assure thorough cleaning of the chute 14. Thereafter, the chute cleaning tool 12 is reversed and the flexible portion 28 is used to squeegee any excess water out of the chute 14 and, thus, to prevent rusting of the chute 14.

Figure 4:
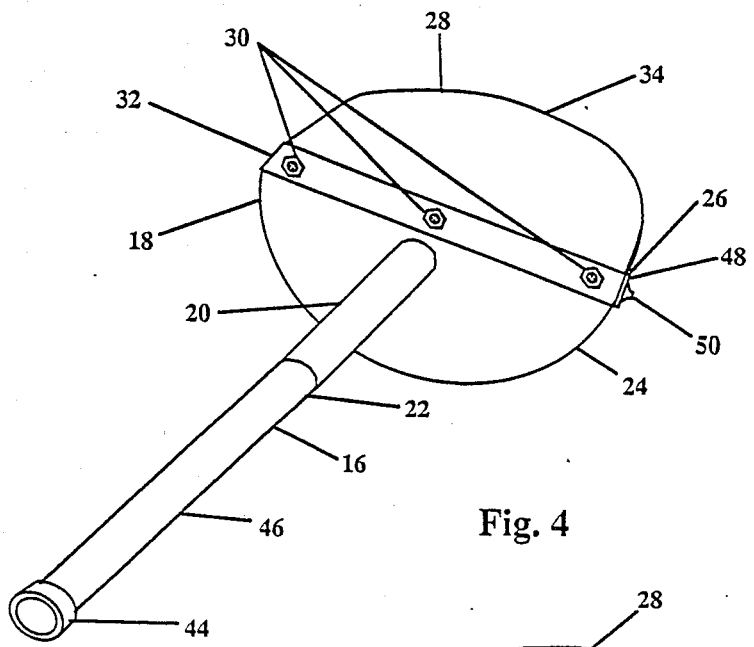
FIG. 4 is a diagrammatic representation showing an alternative form of the chute cleaning tool of FIG. 1.
Figure 5:
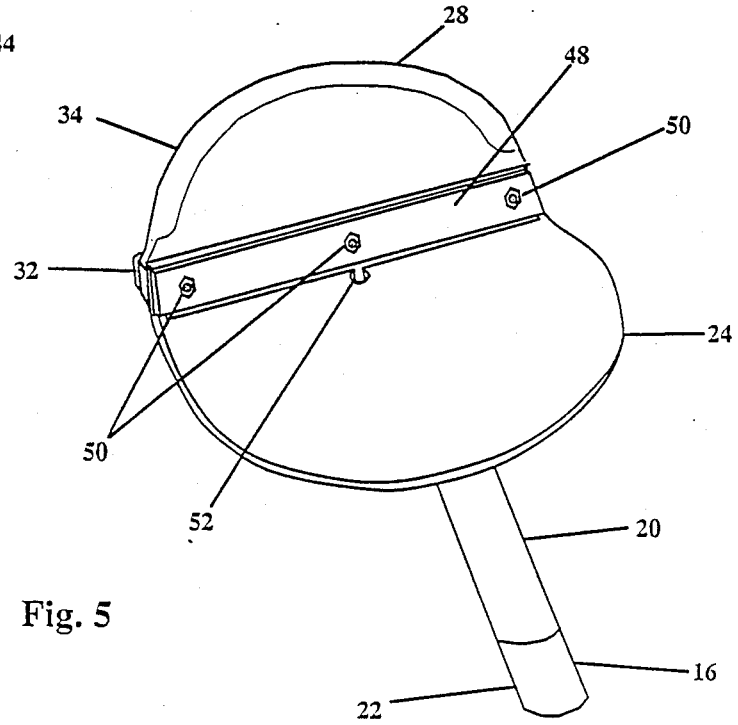
FIG. 5 is an enlarged view of the head of the chute cleaning tool of FIG. 4

FIGS. 4 and 5 show an alternative form of the chute cleaning tool 12 wherein the handle 16 is formed of metal or plastic tubing and a hose connection 44 is provided on the end 46 of the handle 16. A spray head 48 is secured to the flange 26 of the rigid plate portion 24 of the head 18 and extends diametrically across the head 18 and is provided with a plurality of nozzles 50 or the like for delivery water to the work area. Suitable means, such as tube 52, may be provided to delivery water from the interior of the handle 16 to the spray head 48. With the spray head 48, water can be delivered through the handle 16 and spray head 48 to that area of the delivery chute 14 where the cleaning operation is actually in progress. Consequently, maximum efficiency can be achieved in the use of water to reduce the quantity of water needed for the cleaning operation and to reduce waste.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

I claim:

1. A concrete truck delivery chute cleaning tool comprising:

an elongated handle; and a generally disc-shaped head portion mounted on one end of said handle and extending substantially perpendicularly thereto, said head portion comprising a generally semicircular rigid plate portion, and a generally semicircular flexible portion extending opposite to said plate portion.

2. The chute cleaning tool of claim 1 further comprising:

said plate portion of said head having a sleeve projecting from the back thereof for slideably receiving one end of said handle.

3. The chute cleaning tool of claim 2 further comprising:

a flange portion extending above said sleeve and projecting forwardly at an angle of approximately 45° with said flexible portion being secured to said flange.

4. The chute cleaning tool of claim 1 further comprising:

said flexible portion tapering radially outward to provide a squeegee edge.

5. The chute cleaning tool of claim 1 further comprising:

said handle being formed of tubing of sufficient strength to permit vigorous scraping of said chute.

6. The chute cleaning tool of claim 5 further comprising:

hose connection means for connecting a water hose to deliver water through said handle, and spray head means mounted on said head portion and connected to receive water from said handle and to spray said water on said chute.

7. The chute cleaning tool of claim 6 wherein:

said spray head is mounted on said flange of said plate portion of said head.

8. The chute cleaning tool of claim 1 further comprising:

spray head means mounted on said head portion and connected to receive water and to spary said water on said chute.

* * * * *